US006067754A

United States Patent [19]

Bellart

[11] Patent Number: 6,067,754

[45] Date of Patent: May 30, 2000

[54] BASEMENT WINDOW

[75] Inventor: Thomas A. Bellart, Muskego, Wis.

[73] Assignee: Unlimited, Inc., Oak Creek, Wis.

[21] Appl. No.: 09/098,856

[22] Filed: Jun. 17, 1998

[51] Int. Cl.[7] ..... E05D 13/00

[52] U.S. Cl. ..... 49/453; 49/504; 52/204.7

[58] Field of Search ..... 49/380, 504, 505, 49/DIG. 2, 453, 194, 467, 468; 52/204.7, 210, 211, 212

[56] References Cited

U.S. PATENT DOCUMENTS

| | | | |
|---|---|---|---|
| 4,687,519 | 8/1987 | Bruchu | 49/DIG. 2 |
| 4,924,628 | 5/1990 | Ruby et al. | 49/DIG. 2 |
| 5,544,450 | 8/1996 | Schmidt et al. | 49/453 |
| 5,675,937 | 10/1997 | Stebel | 49/453 |
| 5,678,366 | 10/1997 | Nambo et al. | 49/467 |
| 5,771,640 | 6/1998 | Back | 52/204.7 |

*Primary Examiner*—Daniel P. Stodola
*Assistant Examiner*—Curtis A. Cohen
*Attorney, Agent, or Firm*—Cook, Alex, McFarron, Manzo & Cummings & Mehler, Ltd.

[57] ABSTRACT

An assembled basement window for insertion in a building form into which concrete will be poured around the window. The window will have an outer frame fabricated form pieces cut to length from a common extrusion. A header and jambs will be cut to length from a common extrusion. The header and jambs and a sill are assembled into the outer frame so as to form an inner window frame into which the window sashes can be removably inserted. The components of the inner frame can be removably inserted into the outer frame in different orientations. If the window as assembled is placed in a form upside down or inside out, the sashes and inner frame can be removed and reoriented without having to remove the outer frame.

11 Claims, 4 Drawing Sheets

BASEMENT WINDOW

BACKGROUND OF THE INVENTION

This invention relates, generally, to innovations and improvements in basement windows of the type which, in fully assembled condition, are designed to be inserted in a building foundation concrete form and remain in place after concrete has been poured around them. Basement windows of this general type are commercially available from a number of manufacturers. However, such currently available basement windows are designed to be installed in only one correct orientation. Accordingly, if one of these windows is installed upside down and/or inside out it has to be removed and usually replaced with another assembled window which is correctly installed after the opening has been repaired for its installation. The cost of the discarded basement window and labor involved in its removal and repair of the opening for installation of its replacement, add significantly to the cost of construction.

SUMMARY OF THE INVENTION

Fully assembled basement windows are provided in accordance with the present invention which, while designed and intended to be installed in one particular orientation can, if installed upside down and/or inside out, be re-assembled on the interior without requiring removal, replacement or re-installation.

For a more complete understanding of the nature and scope of the invention reference may be had to the following detailed description thereof taken in connection with the accompanying drawings wherein:

BRIEF DESCRIPTION OF THE DRAWINGS

Referring to FIG. 1, a fully assembled basement window is indicated generally at 5 with the legends "TOP-OUTSIDE" and "TOP-INSIDE" on the top of the window indicating to the installer the correct orientation for the window to be inserted in a foundation form into which concrete is to be poured so as to permanently embed a window 5 at its bottom and on its opposite sides. However, as indicated above and as will be described infra, the window 5 can be installed upside down and/or inside out without its outer frame having to be removed.

Figure 1:
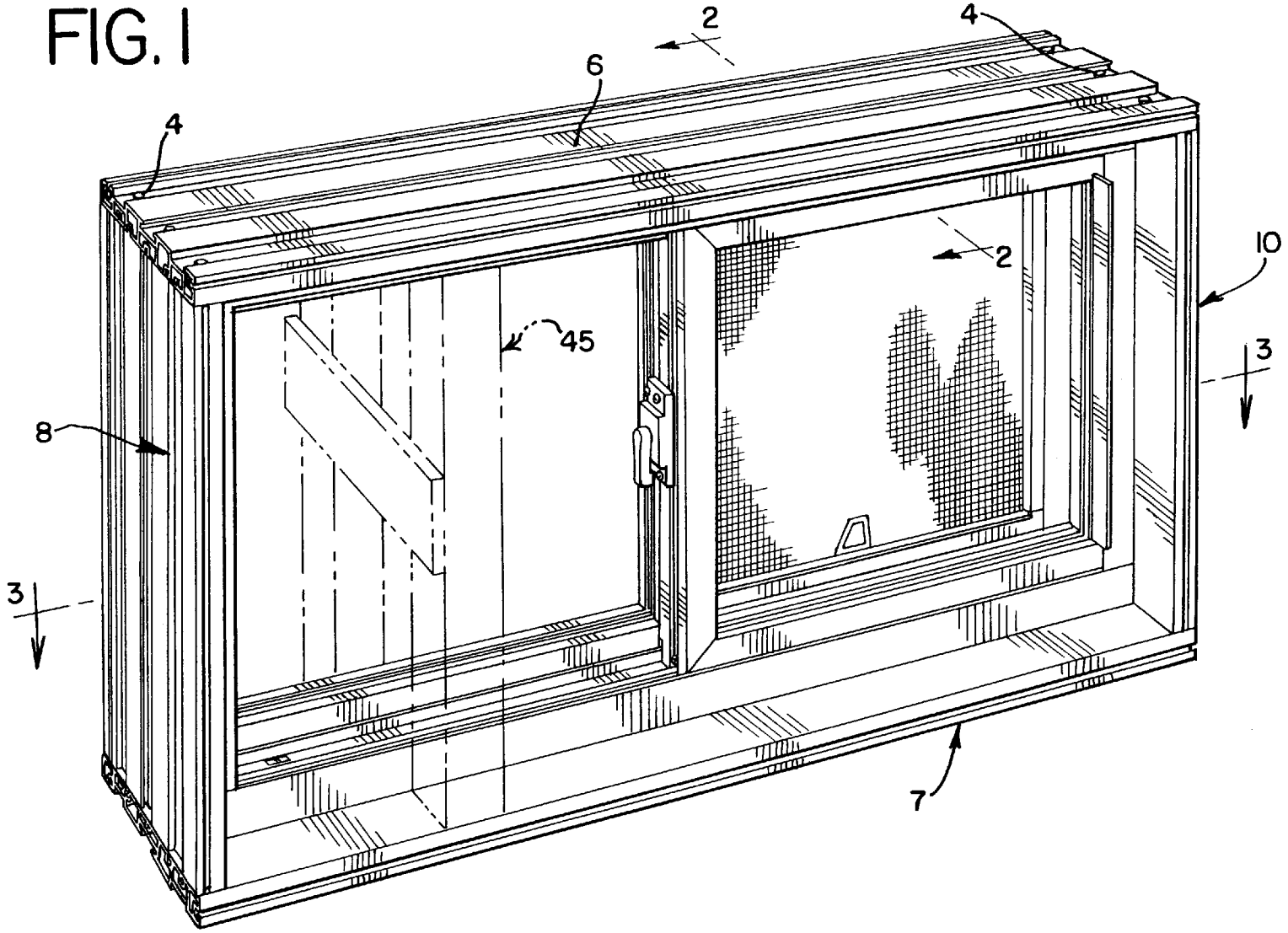
FIG. 1 is a perspective view of a fully assembled basement window forming a preferred embodiment of the invention.

The window 5 has an outer or outside rectangular frame formed by a top panel 6 a bottom panel 7 and end panels 8 and 10. The top and bottom panels 6 and 7 can be identical and likewise the end panels 8 and 10 will be identical. The outer frame of the window 5 is retained in its assembled condition by a plurality of screw fasteners 4—4 as hereinafter further described.

Figure 2:
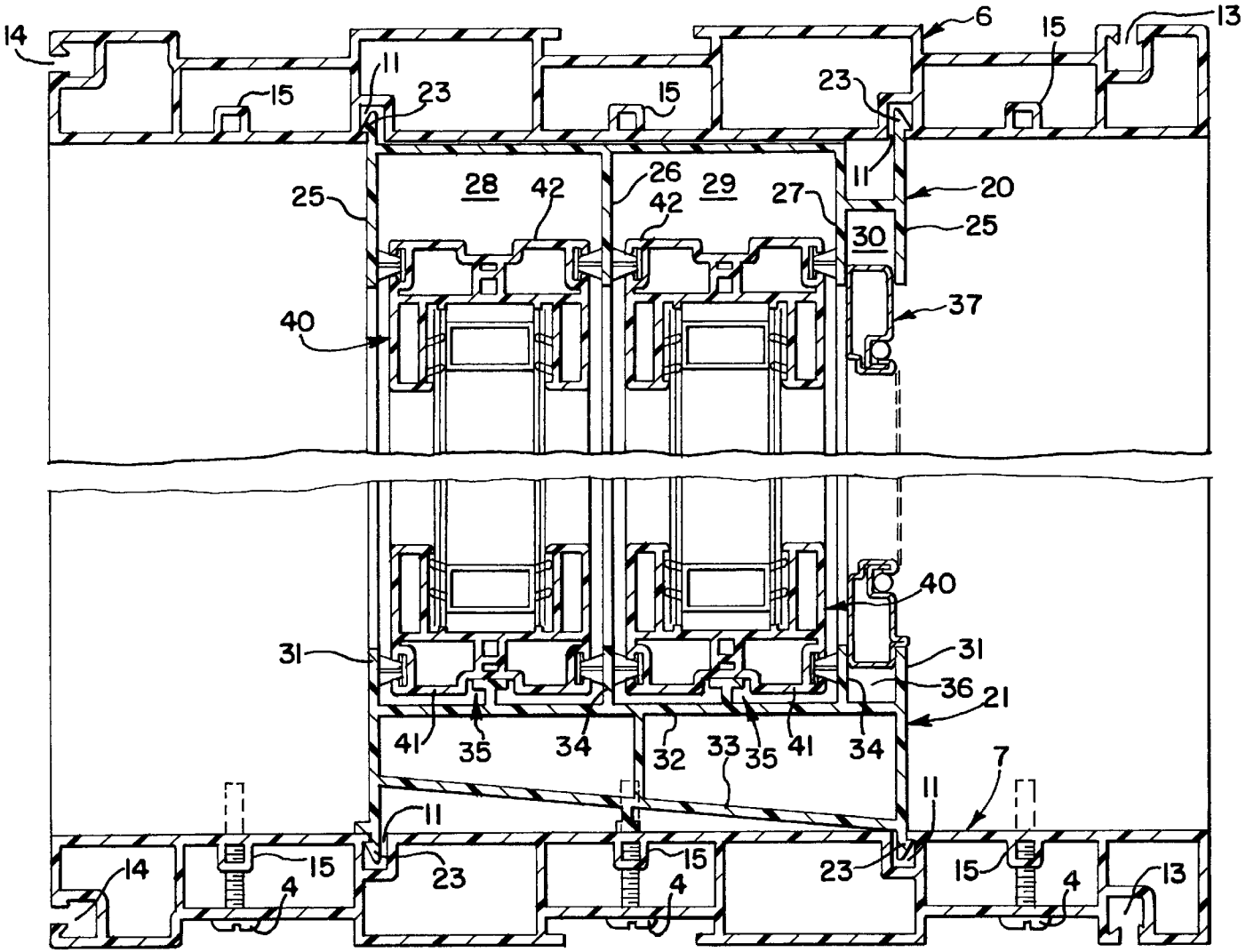
FIG. 2 is an end elevational view taken on line 2—2 of FIG. 1, the end frame panel being removed.
Figure 3:
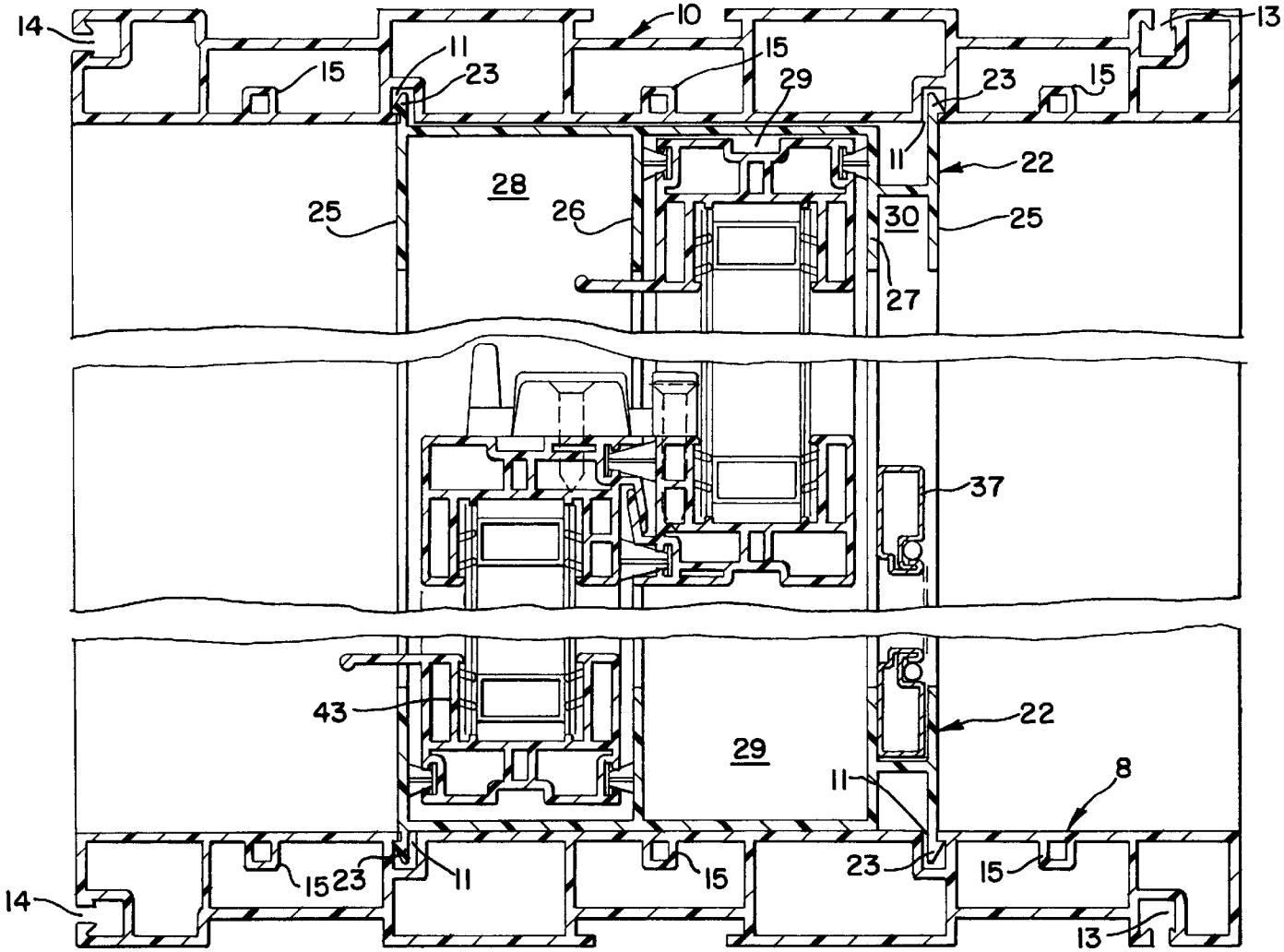
FIG. 3 is a top plan view taken on line 3—3 of FIG. 1, top frame panel being removed.
Figure 4:
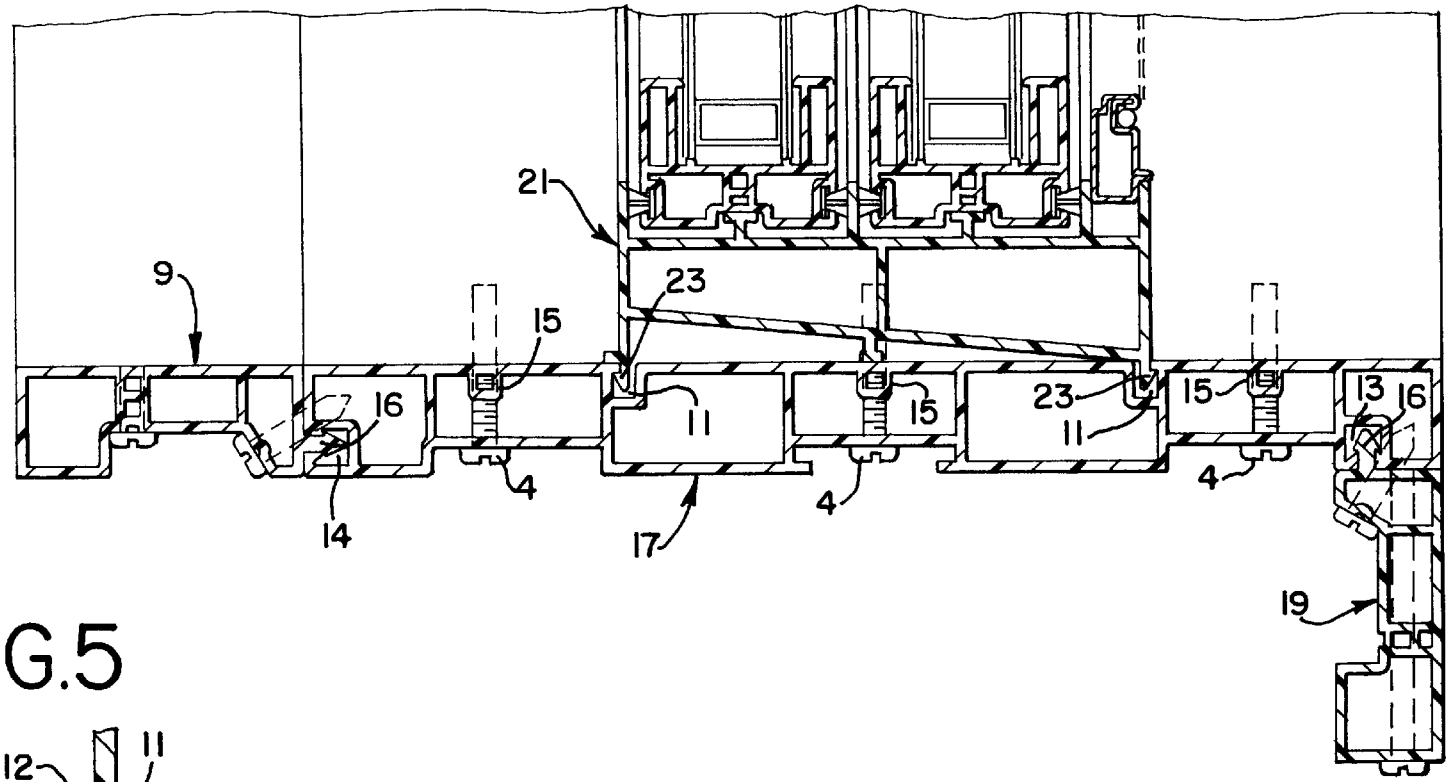
FIG. 4 is a bottom fragmentary end elevational view corresponding to FIG. 2 with inside and outside extensions added to the outer frame.

The top and bottom panels 6 and 7 and the end panels 8 and 10 are each cut to length from a common extrusion shown in cross section in FIGS. 2–4.

In order to help keep the window 5 in its square condition as manufactured and assembled it can be provided with temporary rectangular wooden bracing (not shown) and also a temporary transverse vertical brace which serves a dual purpose as hereinafter described.

Figure 5:
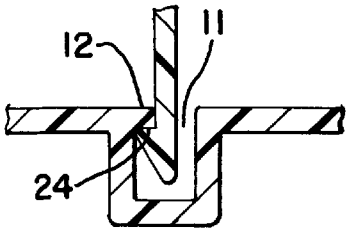
FIG. 5 is a fragmentary end elevational view, on enlarged scale, showing one of the several connections whereat inner frame parts are removably connected to outer frame panels of the window of FIGS. 1–4.

As extruded and assembled, each panel 6, 7, 8 and 10 has on the interior a pair of parallel longitudinally extending grooves 11—11 (FIG. 5) having along the open side of each groove an integrally formed overhang 12. The opposite longitudinal sides of each of the panels 6, 7, 8 and 10 is each formed with grooves 13 and 14, with the grooves 13 opening outwardly at right angles to the window interior while the grooves 14 open horizontally outwardly from lateral edges of the panels.

In order to minimize material, maximize strength and facilitate extrusion, the panels 6, 7, 8 and 10 will have a generally honeycomb cross section construction which incorporates the grooves 11, 13 and 14 as well as parallel longitudinally extending interior hollow ribs 15—15 which are located so as to receive the ends of screw fasteners 4—4 (FIGS. 1, 2, and 4).

Generally the outer frames of the window 5 will have a front-to-rear width of about 8 inches. However, the edge opening grooves 14 provide for the attachment of lateral extension pieces 9 (FIG. 4). Each extension piece 9 has a male attaching projection 16 integrally formed and extending along one edge which is arrow or bayonet shaped-so as to snap into a groove 14 with opposing internal shoulders, as shown. In like manner, in order to provide for the addition of a foundation area well an extension piece 19 (FIG. 4) may be added to the outer side of the bottom panel 7. The end flanges of an area well can be suitably attached to the end piece 19 in known manner.

The outer rectangular frame of the window 5 provided by the panels 6, 7, 8 and 10 has assembled on its interior an interior frame provided by a header indicated generally at 20 (FIG. 2), a sill indicated generally at 21 (FIG. 2) and jambs indicated generally at 22 (FIG. 3). The header 20 and jambs 22 are each cut to length from the same extrusion while the sill 21 is cut to length from a separate sill extrusion.

On one side or face, which is their outer side or face when the header 20, sill 21 and jambs 22 are installed, relatively short attaching male projections 23—23 (FIG. 5) extend which are shaped so as to have lateral shoulders 24—24. The projections 23 are spaced apart along the outer lateral corners of the header 20, sill 21 and jambs 22 so as to snap into the grooves 11 in panels 6 and 7. The shoulders 24 on the projections 23 engage the shoulders 12—12 of the grooves 11 thereby removably retaining the header 20, sill 21 and the jambs 22 in place. The projections 23 have sufficient flexibility to allow them to be inserted and removed from the grooves 11.

On their interior faces or sides the header 20 and jambs 22 are formed with relatively high outer sides 25—25 and parallel inner partitions 26 and 27. One of the sides 25 and the opposing partition 26 of the header 20 and of the jambs 22 form a deep channel 28 therebetween (FIGS. 2 and 3) for receiving a window sash. Likewise, each partition 26 and the opposing partition 27 together form therebetween a similar channel 29. Each partition 27 and adjacent outer side 25 together form therebetween a window screen receiving channel 30.

The sill 21 (FIG. 2) is cut to length from a sill extrusion which on its outer side or face has male attaching projections 23 which removably lock into a pair of the grooves 11 in the outer frame bottom 7. The sill 21 is formed with vertical side walls 31 integrally connected by an upper horizontal floor 32 and an inclined lower floor 33. The purpose of the inclined lower floor 33 is to allow moisture or water collecting thereon to drain outwardly onto the bottom frame member 7. Intermediate the side walls 31 the sill 21 is formed with vertical dividers 34—34. One of the side walls 31 and a divider 34 provide therebetween a channel 35 for receiving a window sash. The same divider 34 and the other divider 34 likewise form therebetween a second sash channel 35. The last-mentioned divider 34 and the adjacent side wall 31 form therebetween a narrow channel 36 which receives the bottom side of a window screen which is indicated generally at 37.

The inner frame for the windows 5 formed by the header 20, sill 21 and jambs 22 is adapted to receive a set or pair of horizontally sliding windows indicated generally at 40—40. The bottom rails 41 of the windows 40 rest and slide in the channels 35 in the sill 21. The upper rails 42—42 fit and slide in the channels 28 and 29 of the header 20. When the windows 40 are fully closed as shown in FIG. 3 their outer stiles 43—43 fit and recess into the channels 28 and 29 in the jambs 22.

The construction of the windows 40 and of the inner window frame is such that the windows 40 may be readily removed and replaced. Likewise, when the windows 40 are removed, the header 20, sill 21 and jambs 22 may all be removed and replaced or relocated as desired. As a result of this removal and replacement feature, the window 5 has no fixed single orientation. For example, if the window 5 is installed upside down with the sill 21 on the top and the header 20 on the bottom, these parts can be removed and interchanged so that the header 20 will be at the top and the sill 21 at the bottom. Similarly, if the window 5 is installed inside out the header 20, sill 21 and jambs 22 can be removed and reinstalled after turning 180 degrees.

As assembled for installation the window 5 will usually have a disposable rectangular wooden bracing frame and a disposable vertical brace. The vertical brace shown in broken line and indicated generally at 45 in FIG. 1 is designed so as to have a dual function. In addition to providing vertical bracing between the top and bottom of the window 5 the vertical brace 45 may be laid horizontally over the sill 21 in interfitting relationship therewith when one of the windows is opened or removed. In this position, the vertical brace serves to shield to protect the underlying sill when the window opening is used to receive a concrete chute when a basement floor is being poured or when other objects are passed through the open window.

While the windows 5 are preferably formed by extrusion entirely from polyvinyl or other suitable plastics, they can also be formed from other materials such as extrudable aluminum alloys.

What is claimed is:

1. An assembled basement window for insertion in a building foundation form so as to have concrete poured around it, comprising: an outer rectangular frame having a top, bottom and sides which are cut to predetermined lengths from a common window frame extrusion with their inner surfaces having pairs of parallel longitudinally-extending projection-receiving grooves therein; a removable inner rectangular frame formed from a header, a pair of jambs and a sill, said header and said pair of jambs cut to predetermined lengths from a common header and jamb extrusion with each having a pair of parallel longitudinally extending retention projections protruding from one side and spaced so as to be removably inserted into a pair of said longitudinally-extending projection-receiving grooves and with each having parallel longitudinally extending window sash receiving channel formations on its opposite side; a sill cut to a predetermined length from an extrusion having a pair of parallel longitudinally extending sill retention projections protruding from one side and spaced so as to be removably inserted in a pair of said projection-receiving grooves in said frame bottom and having parallel longitudinally extending window sash receiving channel formations on the opposite side; and, a pair of horizontally slidable windows mounted within said inner rectangular frame.

2. An assembled basement window for insertion in a building foundation form so as to have concrete poured around it, comprising: an outer rectangular frame the top, bottom and sides of which are cut to predetermined lengths from a common window frame extrusion with their inner surfaces having pairs of parallel longitudinally-extending projection-receiving grooves therein; a rectangular inner frame comprising in-part a header and a pair of jambs cut to predetermined lengths from a common header and jamb extrusion with each having an outer face and an inner face, said header having on its outer face a pair of parallel longitudinally extending retention projections spaced so as to be removably inserted into the pair of projection-receiving grooves in said outer frame top, and each of said jambs having on its exterior face a pair of parallel longitudinally extending retention projections spaced so as to be removably inserted into the pair of said longitudinally-extending projection-receiving grooves in one of said frame sides, and each of said header and pair of jambs having parallel longitudinally extending window sash receiving channel formations on its interior face; a sill forming a part of said inner frame and cut to a predetermined length from an extrusion and having an outer face and an inner face, said sill having on its outer face a pair of parallel longitudinally extending sill retention projections spaced so as to be removably inserted in a pair of said projection-receiving grooves in said frame bottom and having parallel longitudinally extending window sash receiving channel formations on its interior face; and, a pair of horizontally slidable windows mounted within said inner rectangular frame.

3. The assembled basement window called for in claim 2 said outer frame bottom having an outwardly and horizontally facing retention projection-receiving groove extending longitudinally along one edge for removably receiving a longitudinally extending retention projection on a frame extension member.

4. The assembled basement window called for in claim 3 a frame extension member having a longitudinally extending retention projection removably inserted in said outwardly and horizontally facing retention projection-receiving groove.

5. The assembled basement window called for in claim 2 said outer frame bottom having an outwardly and downwardly facing retention projection-receiving groove extending longitudinally along its bottom surface for removably receiving a longitudinally extending retention on a frame extension member.

6. The assembled basement window called for in claim 5 a frame extension member having a longitudinally extending retention projection removably inserted in said outwardly and downwardly facing retention projection-receiving groove.

7. The assembled basement window called for in claim 2 each said projection-receiving groove having an interior shoulder and each said retention projection having a shoulder which engages said interior shoulder.

8. The assembled basement window called for in claim 2 wherein said retention projections are sufficiently flexible to be removably insertable in said retention projection-receiving grooves.

9. The assembled basement window called for in claim 2 wherein said outer and inner frame extrusions are formed of plastic.

10. A basement window frame assembly for insertion in a building foundation form so as to have concrete poured around it, comprising: an outer rectangular frame the top, bottom and sides of which are cut to predetermined lengths from a common window frame extrusion with their inner surfaces having pairs of parallel longitudinally-extending projection-receiving grooves therein; a header and a pair of jambs cut to predetermined lengths from a common header and jamb extrusion and each having a pair of parallel longitudinally extending retention projections protruding from one side and spaced so as to be removably inserted into a pair of said longitudinally-extending projection-receiving grooves and each having parallel longitudinally extending window sash receiving channel formations on its opposite side; and a sill cut to a predetermined length from an extrusion having a pair of parallel longitudinally extending sill retention projections protruding from one side and spaced so as to be removably inserted in a pair of said projection-receiving grooves in said frame bottom and having parallel longitudinally extending window sash receiving channel formations on the opposite side.

11. A basement window frame for insertion in a building foundation form so as to have concrete poured around it, comprising: an outer rectangular frame the top, bottom and sides of which are cut to predetermined lengths from a common window frame extrusion with their inner surfaces having pairs of parallel longitudinally-extending projection-receiving grooves therein; an inner frame comprising in-part a header and a pair of jambs cut to predetermined lengths from a common header and jamb extrusion and each having an outer face and an inner face, said header having on its outer face a pair of parallel longitudinally extending retention projections spaced so as to be removably inserted into the pair of projection-receiving grooves in said outer frame top, and each of said jambs having on its exterior face a pair of parallel longitudinally extending retention projections spaced so as to be removably inserted into the pair of said longitudinally-extending projection-receiving grooves in one of said frame sides and said header and each of said pair of jambs having parallel longitudinally extending window sash receiving channel formations on the interior face of each; and, a sill forming a part of said inner frame and cut to a predetermined length from an extrusion and having an outer face and an inner face, said sill having on its outer face a pair of parallel longitudinally extending sill retention projections spaced so as to be removably inserted in a pair of said projection-receiving grooves in said frame bottom and having parallel longitudinally extending window sash receiving channel formations on its interior face.

* * * * *